United States Patent [19]

Stratman

[11] 4,016,652

[45] Apr. 12, 1977

[54] BI-AXIAL LEAF SIGHT

[75] Inventor: Urban Frederick Stratman, Taylor Ridge, Ill.

[73] Assignee: The United States of America as represented by the Secretary of the Army, Washington, D.C.

[22] Filed: Nov. 24, 1975

[21] Appl. No.: 634,673

[52] U.S. Cl. ..... 33/254; 33/255; 33/258; 33/261

[51] Int. Cl.[2] ..... F41G 1/06; F41G 1/10; F41G 1/48

[58] Field of Search ..... 33/233, 235, 252, 253, 33/254, 255, 256, 257, 258, 261

[56] References Cited

UNITED STATES PATENTS

| | | | |
|---|---|---|---|
| 659,606 | 10/1900 | Formby | 33/261 |
| 766,658 | 8/1904 | Beal | 33/261 |
| 799,206 | 9/1905 | Thring | 33/261 |
| 1,406,620 | 2/1922 | Dear | 33/253 |

*Primary Examiner*—Richard E. Aegerter
*Assistant Examiner*—Richard R. Stearns
*Attorney, Agent, or Firm*—Nathan Edelberg; Harold H. Card, Jr.; Robert O. Richardson

[57] ABSTRACT

Sighting system for hand held grenade launchers including a rear leaf sight having two sets of range indicia markings. A first front sight is spaced from the leaf sight for short to intermediate sighting alignment with one set of rear sight markings and a second front sight is offset from the first sight and spaced from the leaf sight for intermediate to long range sighting alignment with the other set.

3 Claims, 3 Drawing Figures

BI-AXIAL LEAF SIGHT

Government Interest

The invention described herein may be manufactured and/or used by or for the Government for governmental purposes without the payment of any royalty thereon.

Background of the Invention

Heretofore, both rifle mounted grenade launchers or hand held self contained grenade launchers for firing of low velocity grenades generally utilized the conventional rifle front and rear sights for aiming during the grenade firing mode. In some cases auxiliary sighting systems independent of the rifle conventional front and rear sights were utilized but even these had a limited effective target range on the order of approximately 200 meters. In still other prior art design involving grenade launchers of the self contained type, the grenade launcher's overall design configuration involved a radical departure from the conventional rifle stock, barrel and receiver design, primarily because the conventional rifle stock did not permit shoulder positioning of low velocity grenade launchers at high elevation angles for long distance firing without blocking the grenadier's view from sights to the target.

For long range firing, such as 200 to 400 meters, the grenadier had to buffer firing with his ribs or stomach, rather than his shoulder, to avoid losing his target field of view, because of this obstruction to his line of sight caused by the weapons' barrel being angled upwardly. Even with such stock configuration design changes for the self contained type grenade launchers, the calibration of the rear sight, if the leaf type, required a substantial increase in the height of the leaf sight for long range aiming over 200 meters. Moreover, there is some point where stock design changes to compensate for reduction in the leaf sight height would require a complete redesign of the weapons overall configuration, particularily where the firing range of the weapon was to be increased in the order of 100%, such as to 400 meters.

Prior attempts to modify rifle sighting systems to extend the firing range of the weapon for grenade launching also involved use of a removeable quadrant type rear-front sight combination located adjacent the fixed rear sight of the rifle. This quandrant type sight involved potential injury problems to the user in that the spaced sighting apertures, being offset on the left side of the weapon from the longitudinal axis of the barrel and adjacent the cheek and mouth of the user, on recoil, could cut the cheek or mouth of the user.

SUMMARY OF INVENTION

The above and other problems, difficulties and disadvantages of the prior art are substantially overcome by utilization of the grenade launcher sighting system of the present invention including a single rear sight member employable selectively in conjunction with one of a pair of vertically spaced front sight members in order to extend the ballistic range of the grenade launcher by enabling effective sighting throughout the range of 25 to 400 meters.

The single rear leaf signt member of the present invention functions in one aiming mode in conjunction with the first front sight member for near to intermediate target firing distances and, in a second aiming mode, with the second front sight member for aiming at intermediate to distant targets.

The single rear leaf sight includes a centrally located first indexing system of the "ladder" type which is vertically precalibrated with visually observable target distance or range markings and used in conjunction with the first front sight member or post for elevational aiming at near to intermediate targets for firing with low velocity grenades.

The single rear leaf sight member also carries on one side a second ladder indexing system which is also vertically precalibrated with visually observable target distance or range markings. The second indexing system, being on the side of the leaf sight member, is useable, as a separate sighting system, with the second front sight or post member which is vertically and radially displaced from the first indexing system for aiming at intermediate to distant targets.

Thus, the first indexing system of the single rear leaf sight and the first front post member define a first line of sight alignment path to near or intermediate targets and the second indexing system and the second front sight or post member define a second independent line of sight alignment path to intermediate or distant targets.

BRIEF DESCRIPTION OF THE DRAWING

The foregoing and other features, objects, and advantages of the present invention will become readily apparent to one skilled in the art from a reading of the following description of a preferred embodiment of the present invention, when read in conjunction with the accompanying drawing, wherein like reference numerals refer to like and corresponding parts throughout the several views, and wherein.

Description of Preferred Embodiment

Figure 1:
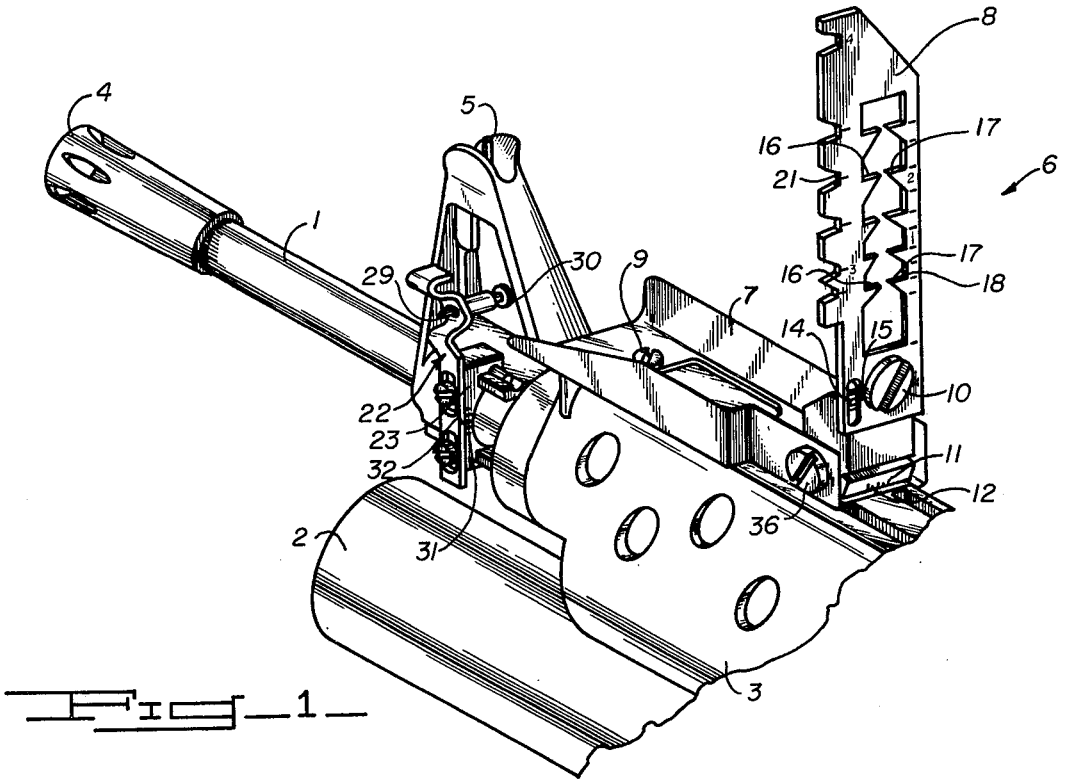
FIG. 1 is a perspective view of the sighting system of the present invention shown mounted on a rifle-grenade launcher combination.
Figure 2:
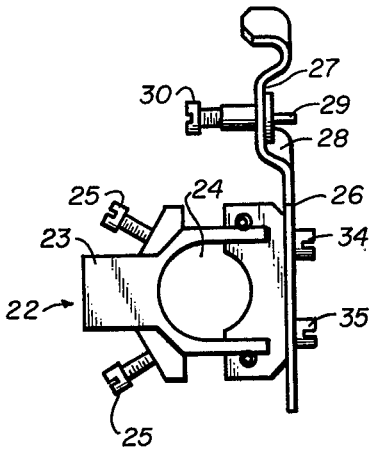
FIG. 2 is a front plan view of the second front sight member shown in FIG. 1.
Figure 3:
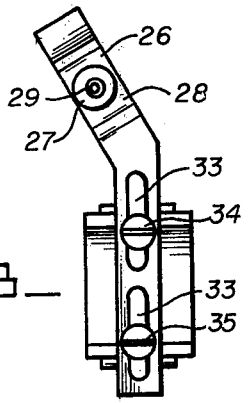
FIG. 3 is a side view of the second front sight member shown in FIG. 2.

FIG. 1 illustrates an adaptation of the present invention for use with a combined rifle-grenade launcher weapon. The weapon includes a rifle barrel 1 and a grenade launcher tube 2. The handguard 3 of the rifle carries adjacent the rifle muzzle end 4 a vertically positioned upstanding first front sight post member 5 which is normally usable as the front sight post member with a rear sight member (not shown) for point firing of the rifle during use of the weapon in the rifle mode.

Also carried by the handguard 3 closely adjacent the front sight post member 5 is a rear leaf sight assembly generally indicated by the numeral 6 including a mounting base member 7 and a leaf sight member 8 pivotally connected to the base member 7. The base member 7 is attached to the upper surface of the handguard 3 as at 9, by screws, and the rear leaf sight member 8 is pivotally connected to the base 7 by screw means 36. Normally when the rear leaf sight 8 is not in use, it is nested in a horizontal position (not shown) in the base 7 to prevent snagging of the sight 8 in underbrush. The sight member 8 is also pivotable rearwardly with respect to its generally vertical position shown in FIG. 1 in the event the sight 8 is frontally impacted unexpectedly while in the vertical position. Adjusting screw 36 is used for incremental horizontal movement of the rear leaf sight member 8 to correct for windage and horizontal deflection in accordance with precalibrated markings 11 and 12. Adjusting screw 10 is used for incremental vertical movement of the leaf blade member 8 to correct for range distances in accordance with precalibrated markings 14 and 15. Conventional means may be utilized for making of these adjustments and such structures form no part of this invention.

The first front sight post member 5 is used in conjunction with the rear leaf sight member 8 for aiming of the grenade launcher at near to intermediate targets. To this end, a portion of the center of rear leaf sight member 8 is stamped out to define a vertical opening having a plurality of pairs of spaced inwardly facing projections 16 and 17. Each pair of corresponding projections 16 and 17 are located so as to define a range indexing system and are precalibrated with respect to each other pair of projections 16 and 17 as to define a series of ranges in the near to intermediate range, such as 25 to 275 meters. For example as shown in FIG. 1, the lowermost pair of projections 16 and 17 are marked as at 18 to indicate a 25 meter range and subsequent upwardly markings indicate a 25 meter incremental increase in range up to 275 meters. The range indicia or calibrations from 25 to 275 meters represent target distance ranges in the near to intermediate class. The grenadier, therefore, for sighting and aiming in the precalibrated near to intermediate range, need only align the appropriate range projections 16 and 17 with the front sight post member 5.

For intermediate to distant target sighting, for example, of the order of 200 to 400 meters, the rear leaf sight member 8 is provided with a series of vertically oriented and radially spaced notches 21 located on the side of the leaf sight member 8. These notches 21 are also precalibrated with range indicia and thus spaced with respect to each other for sighting at targets located at different distances from the weapon in the intermediate to distant target zones.

These notches 21 are aligned with a second front sight member, generally indicated by the numeral 22, for sighting, as aforesaid, at intermediate to distant targets.

The second front sight member 22 includes a body 23 having an aperture 24 for permitting the passage therethrough of the barrel 1 of the weapon. Means, such as set screws 25, lock the body 23 securely to the barrel 1 and to the first front sight member 5.

Removeably secured to the body 23 is a vertically upstanding arm 26 which is offset inwardly as at 27 to define a curved sight post viewing aperture 28.

Centrally disposed in the viewing aperture 28 is a horizontally extending second sight post 29, movably adjustable horizontally by threadable screw 30.

Range marking 31 are also provided on the body 23 and a complimentary indicator mark 32 is provided on the side of the arm 26. Vertical adjustment of the arm 26 is provided by slots 33 in the arm 26 through which spaced adjusting screws 34 and 35 extend to permit vertical range adjustment movement and position locking of the arm 26.

The second sight post is located a vertical distance from the first sight post equivalent to the precalculated reduction in the height of the single leaf blade, assuming a leaf blade were used with only the first front post and the leaf blade was calibrated vertically only for the full range sighting — such as 25 to 400 meters.

The second front post is also horizontally displaced from the first sight post by a distance equal to the distance between the vertical axis of the leaf blade and the outer edges of the side notches on the leaf blade. This latter displacement assures that the line of sight alignment between the side notches of the leaf blade and the second front post is parallel to the longitudinal axis of the barrel 1.

Assuming a target is calculated to be within the 25 to 200 meter range, the grenadier first sights through the leaf blade centrally located ladder graduation notches 16 and 17 and aligns the first front sight post 5 with the rear sight, due consideration being given to the estimated target range indicia on the rear leaf sight.

On the other hand, assuming a target is in the intermediate to distant range, the grenadier aligns the appropriate premarked side notch 21 of the leaf sight, the alignment being determined by the estimated distance to the target, with the second side sight member post 29.

It will be appreciated that the present invention provides improved means for sighting of launchers of grenades of the low velocity type through a wide range by employment of a bi-axial sighting system utilizing a single bi-axial rear leaf sight having a "folded" calibration marking sequence in combination with two spaced front sight posts, one front sight post providing a means for sighting for near to intermediate target and the second front sight post providing a means for sighting for intermediate to distant targets.

It is to be understood that, although a preferred embodiment of the present invention has been shown and described herein, the present invention is not limited thereto, because variations and other embodiments will become readily apparent to those skilled in the art from the foregoing description. Accordingly, the present invention should be considered limited only by the scope of the following claims.

I claim:

1. A sighting system for hand held launchers of low velocity grenades including:

a first front vertically extending sight post member in substantive alignment with the longitudinal axis of the base of the launcher, a second front sight post member laterally offset from the first sight post member, said first and second front sight posts being vertically offset a predetermined distance, and a rear leaf sight member of predetermined height having pre-calibrated range indicia and corresponding sighting means thereon, said range indicia and sighting means being separated into two vertically oriented segments laterally displaced from each other, the first indicia segment and sighting means being substantially centrally and vertically located and including a plurality of sight defining means for selective alignment with the first sight post member for aiming at near to intermediate range targets, the second indicia segment segment and sighting means being on one side of said leaf sight member pre-calibrated and marked to indicate target distances in the intermediate to distant range, said second indicia segment and sighting means including a plurality of sight defining means being selectively alignable with said second front sight for aiming at targets in said intermediate to distant range.

2. A sighting system for hand held launchers of low velocity grenades, including:

a pair of front sight post members and a rear leaf sight member having pre-calibrated range indicating indicia thereon, means for mounting one of said front post members vertically in a central location on the front of the barrel of said launcher, means for mounting the second front sight member in a laterally offset position spaced below the first post member, said second front sight member including a sighting element extending at a right angle to the sight member and means for mounting the leaf sight member for vertical adjustment relative to the longitudinal axis of the barrel, said rear leaf sight member including a first predetermined range indicating means comprising a plurality of geometerally defined and interconnecting apertures centrally located and vertically arranged in said leaf sight, range indicating markings on said leaf sight, each marking selectively associated with one of said apertures for range indications, said first mentioned front sight post member and said first range indicating means forming a first line of sight aiming alignment with targets located in near to intermediate ranges, said rear leaf sight member also including a second range indicating means comprising a series of vertically spaced notches on one side of said leaf sight member, additional range indicating markings on said leaf sight, each selectively associated with one of said notches for range indications, said second front sight member, and said second range indicating means defining a separate second line of sight aiming alignment with targets in intermediate to distant ranges.

3. The system of claim 2 wherein said second sight post member includes:

a weapon barrel mount body portion, a separate, vertically extending movable and elongate arm having a U shaped section, said sighting element comprising a moveable horizontal sight post in said U shaped section, means for horizontally adjusting said post for sight alignment with the side notches on said leaf sight, and means for vertically adjusting said arm.

* * * * *